US008347839B2

(12) United States Patent
Berger et al.

(10) Patent No.: US 8,347,839 B2
(45) Date of Patent: Jan. 8, 2013

(54) INTERNAL COMBUSTION ENGINE WITH VARIABLE-LIFT ELECTROHYDRAULIC VALVE ACTUATION

(75) Inventors: Michael Berger, Berching (DE); Thomas Kremer, Furth (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 245 days.

(21) Appl. No.: 12/836,808

(22) Filed: Jul. 15, 2010

(65) Prior Publication Data

US 2011/0023801 A1 Feb. 3, 2011

(30) Foreign Application Priority Data

Jul. 30, 2009 (DE) ..... 10 2009 035 404

(51) Int. Cl.
*F01L 1/34* (2006.01)

(52) U.S. Cl. ..... 123/90.16; 123/90.12; 123/90.39

(58) Field of Classification Search ..... 123/90.15, 123/90.12, 90.16, 90.39
See application file for complete search history.

(56) References Cited

U.S. PATENT DOCUMENTS 5,829,397 A * 11/1998 Vorih et al. ..... 123/90.12
6,694,933 B1 2/2004 Lester
2004/0065285 A1 4/2004 Ulodogan et al.

* cited by examiner

*Primary Examiner* — Zelalem Eshete
(74) *Attorney, Agent, or Firm* — Volpe and Koenig, P.C.

(57) ABSTRACT

An internal combustion engine with a bottom camshaft (1) and an electrohydraulic variable-lift valve actuation of a modular construction type is provided. The hydraulic unit (6) is assembled separately from the internal combustion engine and installed in or on the crankcase (10).

10 Claims, 1 Drawing Sheet

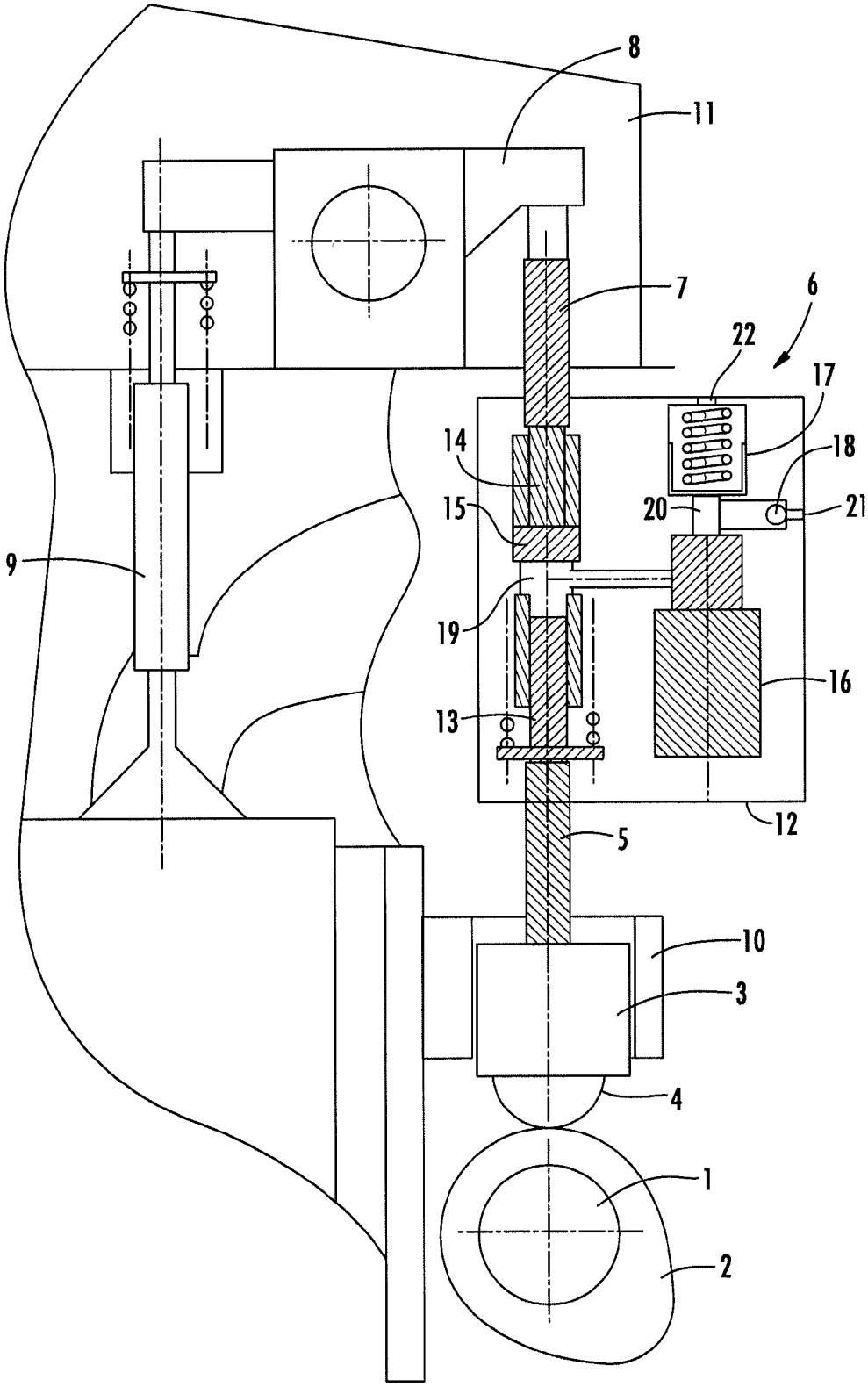
8
11
7
6
22
17
14
18
15
20
21
9
19
16
13
12
5
10
3
4
1
2

INTERNAL COMBUSTION ENGINE WITH VARIABLE-LIFT ELECTROHYDRAULIC VALVE ACTUATION

CROSS-REFERENCE TO RELATED APPLICATIONS

This application claims the benefit of German Patent Application No. 10 2009 035 404.2, filed Jul. 30, 2009, which is incorporated herein by reference as if fully set forth.

FIELD OF THE INVENTION

The invention concerns an internal combustion engine having a variable-lift electrohydraulic valve actuation comprising:

- a crankcase and a cylinder head;
- a camshaft comprising a cam and a cam tappet taking up the cam lift, the camshaft and the cam tappet being arranged outside the cylinder head either in the crankcase or in a camshaft housing mounted on the crankcase;
- a rocker arm and a gas exchange valve actuated by the rocker arm, the rocker arm and the gas exchange valve being arranged in the cylinder head;
- a master piston actuated by the cam tappet and a slave piston which actuates the rocker arm, the master piston and the slave piston defining a variable-volume hydraulic pressure chamber; and
- an electrically operable hydraulic valve and a hydraulic pressure-relief chamber that can be connected through the hydraulic valve to the pressure chamber.

BACKGROUND

Generic internal combustion engines with bottom camshafts (OHV arrangement) and hydraulically variable valve actuation based on the so-called lost motion principle in which the transmission of the cam lift to the gas exchange valve is infinitely variable through the variable-volume pressure chamber disposed between the master piston and the slave piston, are known, inter alia, from US 2004/0065285 A1 and U.S. Pat. No. 6,694,933 B1. In the internal combustion engines disclosed therein, the bottom camshaft is mounted directly in the crankcase. In the case of internal combustion engines with a very large volume (for example marine engines), it is also usual to mount the bottom camshaft in a camshaft housing made separately from the crankcase.

In opposition to the excellent thermodynamic potential of hydraulically variable valve actuation as compared to standard-type valve actuation without lift variability, however, is the considerably higher system complexity which necessitates correspondingly vast construction and manufacturing modifications to the hydraulic valve actuation of an existing engine architecture. The concomitant complexity of manufacturing and the cost increase are particularly high if the otherwise identical internal combustion engine has to be constructed with and without hydraulically variable valve actuation.

SUMMARY

The object of the present invention is therefore to improve an internal combustion engine of the above-noted type, so that the hydraulic valve actuation can be adapted with the lowest possible manufacturing complexity and manufacturing costs.

This objective is achieved according to the invention, while advantageous developments and embodiments of the invention are described below and in the claims. According to the invention, the master piston, the slave piston, the hydraulic valve, the pressure chamber and the pressure-relief chamber together with a common hydraulic housing form an assembled hydraulic unit discrete from the internal combustion engine, which unit is either installed in the crankcase or mounted outside of the cylinder head on the camshaft housing and connected to the hydraulic medium circulation of the internal combustion engine.

In other words, according to the provisions of the invention, the elements specifically required for the hydraulic valve actuation are pre-assembled together into a unit that, during assembly of the internal combustion engine, only has to be inserted into the crankcase, or mounted on the separate camshaft housing, provided with electric contacts and—if this is not already the case—filled with hydraulic medium. Construction modifications to the architecture of the engine can be restricted substantially to the adaptation of the crankcase or the camshaft housing for receiving and fixing the hydraulic unit and replacement of the standard-type tappet push rod between the cam tappet and the rocker arm with the interposed hydraulic unit and possibly required adaptor elements. In addition, the modular construction of the valve actuation enables any required hydraulic and mechanical modification of a hydraulic unit to specifically configured internal combustion engines of a family of engines. A further advantage of the invention results from the handling of the hydraulic unit which can be simply disassembled and also exchanged, if necessary, for example in case of repair.

According to one development of the invention, the hydraulic unit further comprises a pressure reservoir connected to the pressure-relief chamber. As known, this pressure reservoir serves for a rapid refilling of pressure chamber which expands during the cam run-off phase.

An unintentional emptying of the hydraulic unit and the introduction of pressure pulses into the hydraulic medium circulation of the internal combustion engine can be effectively avoided by the fact that the hydraulic unit further comprises a one-way valve opening in direction of the pressure-relief chamber, through which one-way valve, the hydraulic unit is connected to the hydraulic medium circulation of the internal combustion engine.

The aforesaid adaptor elements can be a lower tappet push rod through which the cam tappet actuates the master piston, and/or an upper tappet push rod through which the slave piston actuates the rocker arm.

BRIEF DESCRIPTION OF THE DRAWING

Further features of the invention result from the following description and the appended drawing in which one exemplary embodiment of the invention is shown in a highly simplified and partially schematic representation.

The sole FIGURE shows, in cross-section, an internal combustion engine comprising a variable-lift electrohydraulic valve actuation.

DETAILED DESCRIPTION OF THE PREFERRED EMBODIMENT

The sole FIGURE discloses, in a cross-section essential for understanding the invention, an OHV-type (overhead valve) internal combustion engine comprising a variable-lift electrohydraulic valve actuation. Shown is a camshaft 1 with a cam 2 whose cam lift is taken up by a longitudinally guided cam tappet 3 using a roller 4 and transmitted through a lower tappet push rod 5, a hydraulic unit 6, an upper tappet push rod 7 and a rocker arm 8 to a gas exchange valve 9 which is spring-biased in closing direction. The camshaft 1 (situated underneath), the cam tappet 3, the lower tappet push rod 5 and the hydraulic unit 6 are arranged in the crankcase 10, while the upper tappet push rod 7, the centrally axle-mounted rocker arm 8 and the gas exchange valve 9 extend in the cylinder head 11 of the internal combustion engine. Provided, but not explicitly shown, is also a device for valve lash adjustment which, in a known manner, can be of a mechanical or a hydraulic type.

The hydraulic unit 6 is the central constituent of the variable-lift electrohydraulic valve actuation. The hydraulic unit 6 comprises a single hydraulic housing 12 extending in longitudinal direction of the crankcase 10 parallel to the camshaft 1 and the following elements received in the hydraulic housing 12 in a number corresponding to the number of gas exchange valves 9 to be actuated (intake and/or exhaust valves) or, in the case of lift-identical valve actuation, corresponding to the number of pairs of gas exchange valves:

- a master piston 13 actuated by the lower tappet push rod 5 and loaded in direction of the cam 2 by spring force,
- a slave piston 14 actuating the upper tappet push rod 7, and adjacent thereto and shown only schematically in the drawing, a hydraulic valve brake 15 of a known type, that guarantees a gentle closing of the gas exchange valve in all cases,
- an electrically operable hydraulic valve 16 in the form of a 2/2 directional seat valve open in non-energized state,
- a pressure reservoir 17 comprising a compensating piston loaded by spring force, and
- a one-way valve 18.

The master piston 13 and the slave piston 14 that are guided substantially pressure medium-sealed for longitudinal displacement in housing bores define a variable-volume pressure chamber 19 which is completely filled with hydraulic medium. In the opened state of the hydraulic valve 16, i.e. when the hydraulic valve 16 is not energized, this pressure chamber 19 communicates with a pressure-relief chamber 20 which is defined on one side by the pressure reservoir 17 and on another side by the one-way valve 18 which opens in direction of the pressure-relief chamber 20. The one-way valve 18 is arranged in a housing duct 21 that is connected on the pressure side to the hydraulic medium circulation, not shown, of the internal combustion engine. In contrast, the pressure reservoir 17 is relieved in the pressure-less part, identified at 22, of the hydraulic medium circulation The mode of functioning of the electrohydraulic valve actuation, known per se, can be summarized as follows. The pressure chamber 19 situated between the master piston 13 and the slave piston 14 acts as a hydraulic linkage. The hydraulic volume—neglecting any hydraulic leakage—displaced by the master piston 13 in proportion to the cam lift and as a function of the point of time of opening and the duration of the open state of the hydraulic valve 16, can be split up into a first fractional volume that loads the slave piston 14 and thus opens the gas exchange valve 9 and a second fractional volume that flows into the pressure-relief chamber 20 including the pressure reservoir 17. In this way, it is possible to set, infinitely variably, the lift transmission from the master piston 13 to the slave piston 14 and thus also not only the timing of gas exchange valve 9 but also the lift height of the gas exchange valve 9, right up to its complete shutdown.

The hydraulic unit 6 manufactured separately from the internal combustion engine is inserted, in completely assembled form and filled with hydraulic medium, into the crankcase 10 and fixed at screwing points, not illustrated. Likewise not shown are electric leads and contacts of the hydraulic valve 16 to be connected to the leads.

LIST OF REFERENCE NUMERALS

1 Camshaft
2 Cam
3 Cam tappet
4 Roller
5 Lower tappet push rod
6 Hydraulic unit
7 Upper tappet push rod
8 Rocker arm
9 Gas exchange valve
10 Crankcase
11 Cylinder head
12 Hydraulic housing
13 Master piston
14 Slave piston
15 Valve brake
16 Hydraulic valve
17 Pressure reservoir
18 One-way valve
19 Pressure chamber
20 Pressure-relief chamber
21 Housing duct
22 Pressure-less part of the hydraulic medium circulation

The invention claimed is:

1. An internal combustion engine having a variable-lift electrohydraulic valve actuation comprising:

a crankcase and a cylinder head;

a camshaft comprising a cam and a cam tappet for taking up a cam lift, the camshaft and the cam tappet being arranged outside the cylinder head either in the crankcase or in a camshaft housing mounted on the crankcase;

a rocker arm and a gas exchange valve actuated by the rocker arm, the rocker arm and the gas exchange valve being arranged in the cylinder head;

a master piston actuated by the cam tappet and a slave piston which actuates the rocker arm, the master piston and the slave piston defining a variable-volume hydraulic pressure chamber;

an electrically operable hydraulic valve and a hydraulic pressure-relief chamber that can be connected through the hydraulic valve to the pressure chamber, the master piston, the slave piston, the hydraulic valve, the pressure chamber and the pressure-relief chamber together with a common hydraulic housing are pre-assembled separate from the crankcase and the cylinder head as an assembled hydraulic unit discrete from the internal combustion engine, the hydraulic unit is installed in the crankcase or mounted outside of the cylinder head on the camshaft housing and connected to a hydraulic medium circulation of the internal combustion engine.

2. The internal combustion engine of claim 1, wherein the hydraulic unit further comprises a pressure reservoir that is connected to the pressure-relief chamber.

3. The internal combustion engine of claim 1, wherein the hydraulic unit further comprises a one-way valve that opens in a direction of the pressure-relief chamber, the hydraulic unit being connected to the hydraulic medium circulation of the internal combustion engine through said one-way valve.

4. The internal combustion engine of claim 1, wherein the cam tappet actuates the master piston through a lower tappet push rod.

5. The internal combustion engine of claim 1, wherein the slave piston actuates the rocker arm through an upper tappet push rod.

6. A hydraulic unit for an internal combustion engine having a variable-lift electrohydraulic valve actuation comprising:

a crankcase and a cylinder head;

a camshaft comprising a cam and a cam tappet for taking up a cam lift, the camshaft and the cam tappet being arranged outside the cylinder head in the crankcase or in a camshaft housing mounted on the crankcase;

a rocker arm and a gas exchange valve actuated by the rocker arm, the rocker arm and the gas exchange valve being arranged in the cylinder head;

a master piston actuated by the cam tappet and a slave piston which actuates the rocker arm, the master piston and the slave piston defining a variable-volume hydraulic pressure chamber;

an electrically operable hydraulic valve and a hydraulic pressure-relief chamber that can be connected through the hydraulic valve to the pressure chamber, the master piston, the slave piston, the hydraulic valve, the pressure chamber and the pressure-relief chamber together with a common hydraulic housing are pre-assembled separate from the crankcase and the cylinder head as an assembled hydraulic unit discrete from the internal combustion engine, the hydraulic unit is configured for being installed in the crankcase and for being connected to a hydraulic medium circulation of the internal combustion engine.

7. The hydraulic unit of claim 6, wherein the hydraulic unit further comprises a pressure reservoir that is connected to pressure-relief chamber.

8. The hydraulic unit of claim 6, wherein the hydraulic unit further comprises a one-way valve that opens in a direction of the pressure-relief chamber, the hydraulic unit being able to be connected to the hydraulic medium circulation of the internal combustion engine through said one-way valve.

9. The hydraulic unit of claim 6, wherein the master piston is configured for being actuated by the cam tappet through a lower tappet push rod.

10. The hydraulic unit of claim 6, wherein the slave piston is configured for actuating the rocker arm through an upper tappet push rod.

* * * * *